US010301558B1

(12) United States Patent
Luebke et al.

(10) Patent No.: US 10,301,558 B1
(45) Date of Patent: May 28, 2019

(54) INTEGRATED PROCESS FOR PRODUCTION OF GASOLINE

(71) Applicant: UOP LLC, Des Plaines, IL (US)

(72) Inventors: Charles P. Luebke, Mount Prospect, IL (US); Lin Jin, Des Plaines, IL (US); Christopher DiGiulio, Elmhurst, IL (US); Mark P. Lapinski, Aurora, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 16/049,144

(22) Filed: Jul. 30, 2018

(51) Int. Cl.
*C10G 63/00* (2006.01)
*C10G 69/00* (2006.01)

(52) U.S. Cl.
CPC ..... *C10G 63/00* (2013.01); *C10G 69/00* (2013.01); *C10G 2400/02* (2013.01)

(58) Field of Classification Search
CPC ..... C10G 63/00; C10G 69/00; C10G 2400/02
See application file for complete search history.

(56) References Cited

U.S. PATENT DOCUMENTS 2,479,110 A 8/1949 Haensel
2,972,650 A 2/1961 Burk, Jr. et al.
4,929,333 A 5/1990 Moser et al.
5,128,300 A 7/1992 Chao et al.
5,360,534 A 11/1994 Rice et al.
5,453,552 A 9/1995 Rice et al.
7,495,137 B2 2/2009 Zhou et al.
2006/0270885 A1* 11/2006 Boyer ..... C07C 5/2791 585/741
2014/0171702 A1* 6/2014 Glover ..... C07C 5/13 585/252
2014/0171706 A1 6/2014 Glover
2015/0166438 A1* 6/2015 Glover ..... C07C 5/2772 585/303

* cited by examiner

*Primary Examiner* — Brian A McCaig
*Assistant Examiner* — Jason Y Chong

(57) ABSTRACT

An integrated process for production of gasoline has been described. The process includes a $C_5$-$C_6$ isomerization zone, two $C_7$ isomerization zones separate by a deisoheptanizer, and a reforming zone. The use of two $C_7$ isomerization zones eliminates the need for the large recycle stream from the deisoheptanizer. The low temperature in first $C_7$ isomerization zone favors the formation of multi-branched $C_7$ paraffins and cyclohexanes and maximizes $C_5^+$ yield. The separation between paraffin and cycloalkane in deisoheptanizer becomes easier due to conversion of cycloalkanes to cyclohexanes in the first $C_7$ isomerization zone. Further, the high temperature in second $C_7$ isomerization zone favors the formation of higher octane cyclopentanes over cyclohexanes. An aromatic-containing stream can be introduced to second $C_7$ isomerization zone. The saturation of the aromatics in the second $C_7$ isomerization zone provides heat that increases the reactor outlet temperature in the isomerization reactors to favor cyclopentanes.

20 Claims, 2 Drawing Sheets

INTEGRATED PROCESS FOR PRODUCTION OF GASOLINE

BACKGROUND

Gasoline specifications are becoming stricter and more difficult for refiners to meet. For example, it is difficult for hydrocracker-based refineries to meet the aromatics specifications in the Euro-V gasoline standard while maximizing 95 RONC (research octane number clear) without having a heavy naphtha export stream. For example, certain standards may limit gasoline to concentrations of no more than 35 lv % aromatics; concentration of no more than 1.0 lv % benzene; distillation specifications and Reid vapor pressure (RVP) limit etc. The heavy naphtha stream has lower value, thus reducing the refiner's profitability.

A typical hydrocracker based refinery naphtha block includes a $C_5$-$C_6$ isomerization zone and a catalytic reforming zone. In order to minimize aromatics production, $C_7$ needs to be removed from the feed to the catalytic reforming zone. This can be done with a second naphtha splitter or a side draw from a naphtha splitter, for example. Although this approach minimizes the amount of aromatics produced from $C_{7S}$, it does not allow for 95 RONC gasoline production due to the low blending octanes of components in the $C_7$ stream when blending directly to the gasoline pool.

A solution is to use a single stage $C_7$ isomerization zone with a large recycle stream to maximize the octane of the isomerate. In order to maximize the octane, a deisoheptanizer (DIHP) column is used to produce an overhead stream, a side cut stream, and a bottom stream. The overhead stream primarily comprises high octane multi-branched $C_7$ hydrocarbons. The side draw stream is a mixture of single-branched, normal, and cycloalkane $C_{7S}$. This is a lower octane stream and is recycled back to the reactor to be converted to multi-branched $C_{7S}$. The bottom stream comprises n-heptane, $C_7$ cycloalkanes and heavies. In order to achieve a high proportion of 95 RONC gasoline, the $C_7$ isomerization zone configuration results in very high operating costs due to the large recycle stream and a lack of on-stream flexibility due to the single isomerization stage.

Therefore, there is a need for a more flexible process of making gasoline with an increased amount of 95 RONC.

SUMMARY AND DETAILED DESCRIPTION

Figure 1:
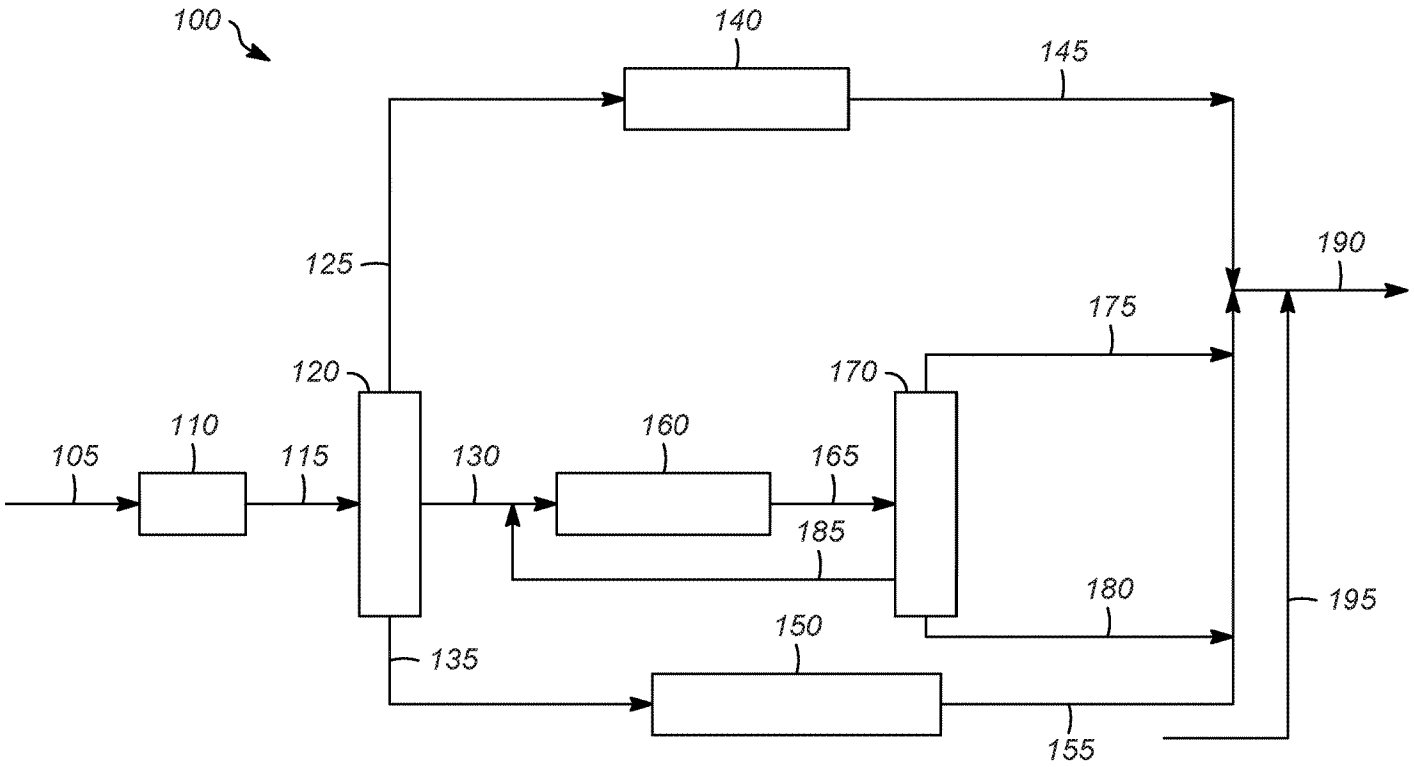
FIG. 1 is an illustration of a gasoline process.

An integrated process for production of gasoline with 95 RONC has been developed. The process includes a $C_5$-$C_6$ isomerization zone, two $C_7$ isomerization zones, and a reforming zone. The use of two $C_7$ isomerization zones eliminates the need for the large recycle stream from the deisoheptanizer. This configuration results in significant savings in operating costs and increases the total gasoline yield from the complex.

The first $C_7$ isomerization zone is designed to isomerize $C_7$ paraffins. The product from the first $C_7$ isomerization zone is sent to a deisoheptanizer column in order to separate a $C_7$ isoparaffin-containing stream (typically 20-100 mol % iso-paraffins, or 30-100 mol %) as an overhead and a $C_7$ cycloalkane-containing stream (typically 20-100 mol % cycloalkane, or 30-100 mol %, or 40-100 mol %, or 50-100 mol %) as a bottom stream. The $C_7$ cycloalkane-containing stream is sent to the second $C_7$ isomerization zone. The second $C_7$ isomerization zone is designed to maximize the isomerization of $C_7$ cycloalkanes to higher octane cycloalkanes. Including a second $C_7$ isomerization zone enables better molecular management and improves the overall operation of the process.

The feed and operating conditions in the two $C_7$ isomerization zones are different in order to increase the octane and selectivity for the process. The first $C_7$ isomerization zone is optimized to increase the isomerization of $C_7$ paraffins and increase the $C_5^+$ retention. This is accomplished by running at lower temperature, which favors the formation of multi-branch $C_7$ paraffins, which have higher blending octanes. The choice of low temperature also reduces the cracking, and therefore increases the $C_5^+$ retention. Because the first $C_7$ isomerization zone has the maximum feed, operating at mild conditions has a significant impact on preserving total $C_5^+$ yield.

The presence of $C_7$ cycloalkane compounds in the feed to the first $C_7$ isomerization zone also inhibits paraffin cracking, increasing the $C_5^+$ yield. The lower temperatures in the first $C_7$ isomerization zone also favor the formation of methylcyclohexane, resulting in easier separation between multi-branched $C_7$ paraffins and $C_7$ cycloalkanes in the downstream deisoheptanizer. Methylcyclohexane has a boiling point of 100.4° C. (213.7° F.), which is much higher compared to the $C_7$ multi-branched paraffins and the $C_7$ cyclopentanes. Specifically, the dimethylcyclopentanes have boiling points between 87.8-91.7° C. (190.1-197° F.), and the multi-branched $C_7$ paraffins have boiling points between 79.2-89.8° C. (174.6° F. to 193.6° F.). The dimethylecyclopentanes include 1,1-dimethylcyclopentane, trans-1,3-dimethylcyclopentane and trans-1,2-dimethylcyclopentane.

The aromatics level in the first $C_7$ isomerization zone should be kept as low as possible to prevent significant exotherms due to aromatics saturation. For $C_7$ streams containing high levels of benzene (e.g., greater than about 2.5 wt %), it is desirable to saturate some or all of the aromatic compounds before isomerizing the $C_7$ stream in the first $C_7$ isomerization zone. A $C_7$ stream with a high benzene level would be sent first to a hydrogenation zone with a hydrogenation catalyst where the benzene is converted to cyclohexane with very low $C_5^+$ yield losses. The resulting $C_7$ stream with cyclohexane would then be fed to the first $C_7$ isomerization zone. Some of the cyclohexane formed from benzene will be isomerized to higher octane methylcyclopentane in the first $C_7$ isomerization zone.

The feed to the second $C_7$ isomerization zone is primarily $C_7$ cycloalkanes, typically 20-100 mol % cycloalkanes, or 30-100 mol %, or 40-100 mol %, or 50-100 mol %. Cycloalkanes contain hydrogen and carbon atoms arranged in a structure containing a single ring with the ring having all single C—C bonds. There may be hydrocarbon side chains on the ring. Cyclopentanes are cycloalkanes (also known as naphthenes) that contain 5-member carbon rings and any number and type of side chains, for example, methylcyclopentane, 1,2-dimethylcyclopantene, ethylcyclopentane, etc. Cyclohexanes are cycloalkanes (also known as naphthenes) that contain 6-member carbon rings and any number and type of side chains, for example, cyclohexane, methylcyclohexane, ethylcyclohexane, etc.

The second $C_7$ isomerization zone is operated under conditions favoring the formation of cyclopentanes over cyclohexanes. The second $C_7$ isomerization zone is optimized to maximize the isomerization of $C_7$ cycloalkanes by operating at higher temperature. The cycloalkanes are more resistant to cracking than paraffins, so the higher operating temperatures in the second $C_7$ isomerization zone are possible without significant loss to light ends. Furthermore, at higher temperatures, equilibrium favors the formation of dimethylcyclopentanes which have a research octane numbers about 10 higher than methylcyclohexane.

The higher temperature of the second isomerization reaction zone helps meet the final blended gasoline specifications. This can be particularly important when meeting the Euro-V gasoline specification for RONC and E100 (vol % evaporated at 100° C.). For naphtha feed lean in $C_5$ and $C_6$, it is challenging to have enough light components to meet the E100 distillation specification (e.g., ≥46 vol %) for Euro-V gasoline. By converting methylcyclohexanes to dimethylcyclopentanes, the percent evaporated at 100° C. will be increased. These isomerization reactions increase the RONC of the stream and reduce the boiling points of the components in the product.

The higher temperatures in the second $C_7$ isomerization zone shift the cycloalkane equilibrium to convert a portion of the cyclohexanes into cyclopentanes; these isomerization reactions are endothermic. When the cycloalkane concentration to the second $C_7$ isomerization zone is greater than about 65 mol %, a temperature drop along the catalyst beds in the second $C_7$ isomerization zone is observed, thus limiting the conversion of cyclohexanes to cyclopentanes. If the temperature drop in the second $C_7$ isomerization zone can be moderated, then an increased equilibrium level of higher octane cyclopentanes can be attained. The addition of an aromatic-containing stream to the second $C_7$ isomerization zone helps to achieve this result. The aromatic-containing stream comprises at least one aromatic compound, such as, but not limited to, benzene and/or toluene. It contains the aromatic compounds in the range of 0.1-100 wt %, or 0.1-90 wt %, or 0.1-80 wt %, or 0.1-70 wt %, or 0.1-60 wt %, or 0.1-50 wt %, or 1-100 wt %, or 1-90 wt %, or 1-80 wt %, or 1-70 wt %, or 1-60 wt %, or 1-50 wt %, or 5-100 wt %, or 5-90 wt %, or 5-80 wt %, or 5-70 wt %, or 5-60 wt %, or 5-50 wt %, or 10-100 wt %, or 10-90 wt %, or 10-80 wt %, or 10-70 wt %, or 10-60 wt %, or 10-50 wt %, or 15-100 wt %, or 15-90 wt %, or 15-80 wt %, or 15-70 wt %, or 15-60 wt %, or 15-50 wt %, or 20-100 wt %, or 20-90 wt %, or 20-80 wt %, or 20-70 wt %, or 20-60 wt %, or 20-50 wt %. Heat is produced when the aromatics are saturated at the conditions of the second $C_7$ isomerization zone. The heat generated moderates the temperature drop or results in a net temperature increase in the second $C_7$ isomerization zone. Since a higher reactor exit temperature has been attained, this leads to an enhanced equilibrium conversion of the cyclohexanes to higher octane cyclopentanes. An aromatic-containing stream can also be added when there are relatively small exotherms across the reactors for cycloalkane contents of about 55-65 mol % if the total exotherm is limited to no more than about 55° C. (about 100° F.).

Additional benefits of adding an aromatic-containing stream to the second $C_7$ isomerization zone include: the heat produced from aromatics saturation can reduce the energy needed to heat the feed of the second $C_7$ isomerization zone; the aromatic levels in the naphtha complex are reduced which help meet the gasoline pool specifications such as Euro-V specifications; and the aromatics convert to saturated cyclohexanes with a portion isomerizing to the higher octane cyclopentanes. For example, benzene would be saturated to form cyclohexane (83.0 RONC) and some would then isomerize to form methylcyclopentane (91.3 RONC). The aromatic-containing stream can be obtained from a reformate splitter or an additional fractionation on the naphtha splitter, for example, or from any other suitable sources.

The improved process enables much lower operating and capital costs, lower initial catalyst loading, and increased yields. For example, in some embodiments, the improved process configuration lowers the operating costs by about 57%, reduces the capital costs by about 11%, increases the octane barrels by about 4%, and increases operating flexibility compared with the existing process. The increased operating flexibility results from the fact that each $C_7$ isomerization zone can be independently controlled to maximize the different isomerization reactions and yield.

One aspect of the invention is an integrated process for production of gasoline. In one embodiment the process comprises separating a naphtha feed in a naphtha splitter into a light stream comprising $C_6$ and lighter boiling hydrocarbons, a $C_7$ stream comprising $C_7$ hydrocarbons, and a heavy stream comprising $C_8$ and heavier hydrocarbons. At least a portion of the light stream from the naphtha splitter is isomerized in a $C_5$-$C_6$ isomerization zone at isomerization conditions to form a $C_5$-$C_6$ isomerization effluent. The $C_7$ stream from the naphtha splitter is isomerized in a first $C_7$ isomerization zone at first isomerization conditions favoring the formation of multi-branched $C_7$ paraffins and cyclohexanes to form a first $C_7$ isomerization effluent. At least a portion of the first $C_7$ isomerization effluent is deisoheptanized in a deisoheptanizer into at least a first stream comprising multi-branched $C_7$ paraffins and a bottom stream comprising n-$C_7$ paraffins and $C_7$ cycloalkane hydrocarbons. The bottom stream from the deisoheptanizer and an aromatic-containing stream comprising at least one aromatic compound are introduced into the second $C_7$ isomerization zone and the flow rate of the aromatic-containing stream is controlled to control a temperature in the second $C_7$ isomerization zone. The bottom stream from the deisoheptanizer and the aromatic-containing stream are isomerized in a second $C_7$ isomerization zone at isomerization conditions favoring the formation of cyclopentanes over cyclohexanes to form a second $C_7$ isomerization effluent. The heavy stream from the naphtha splitter is reformed in a reforming zone under reforming conditions forming a reformate effluent. One or more of: at least a portion of the $C_5$-$C_6$ isomerization effluent, the first stream from the deisoheptanizer, at least a portion of the second $C_7$ isomerization effluent, or the reformate effluent are blended to form a gasoline blend.

In some embodiments, the aromatic-containing stream comprises at least one of benzene or toluene.

In some embodiments, the process further comprises introducing a cycloalkane-containing stream comprising at least one cycloalkane to the second $C_7$ isomerization zone.

In some embodiments, the cycloalkane-containing stream has a cyclopentanes/cycloalkanes molar ratio of about 1:2 or less.

In some embodiments, the second $C_7$ isomerization zone contains a catalyst comprising a metal-containing catalyst.

In some embodiments, the process further comprises hydroprocessing the naphtha feed before separating the naphtha feed.

In some embodiments, the $C_7$ stream from the naphtha splitter further comprises at least one aromatic compound, and the process further comprises hydrogenating at least a portion of the aromatic compounds in the $C_7$ stream from the naphtha splitter before isomerizing the $C_7$ stream from the naphtha splitter.

In some embodiments, the process further comprises separating the first $C_7$ isomerization effluent into an overhead stream comprising hydrogen and $C_4$ and lower boiling hydrocarbons and a second heavy stream comprising $C_5$ and heavier hydrocarbons before deisoheptanizing at least the portion of the first $C_7$ isomerization effluent, and wherein deisoheptanizing at least the portion of the first $C_7$ isomerization effluent comprises deisoheptanizing the second heavy stream.

In some embodiments, the process further comprises separating the second $C_7$ isomerization effluent into a second overhead stream comprising hydrogen and $C_4$ and lower boiling hydrocarbons and a $C_7$ isomerized stream comprising $C_5$ and heavier hydrocarbons, and wherein blending one or more of: the at least the portion of the $C_5$-$C_6$ isomerization effluent, the first stream from the deisoheptanizer, the at least the portion of the second $C_7$ isomerization effluent, or the reformate effluent to form the gasoline blend comprises blending one or more of: the at least a portion of the $C_5$-$C_6$ isomerization effluent, the first stream from the deisoheptanizer, the $C_7$ isomerized stream, or the reformate effluent to form the gasoline blend.

In some embodiments, the process further comprises separating the $C_5$-$C_6$ isomerization effluent into a third overhead stream comprising hydrogen and $C_4$ and lower boiling hydrocarbons and a $C_5$-$C_6$ isomerized stream comprising $C_5$ and heavier hydrocarbons, and wherein blending one or more of: the at least the portion of the $C_5$-$C_6$ isomerization effluent, the first stream from the deisoheptanizer, the at least the portion of the second $C_7$ isomerization effluent, or the reformate effluent to form the gasoline blend comprises blending one or more of: at least a portion of the $C_5$-$C_6$ isomerized stream, the first stream from the deisoheptanizer, the at least the portion of the second $C_7$ isomerization effluent, or the reformate effluent to form the gasoline blend.

In some embodiments, the first $C_7$ isomerization zone conditions include a temperature in a range of 40° C. to 235° C., or wherein the second $C_7$ isomerization zone conditions include a temperature in a range of 150° C. to 350° C., or both.

In some embodiments, the process further comprises mixing at least one additional stream with the gasoline blend.

In some embodiments, the process further comprises at least one of: sensing at least one parameter of the process and generating a signal or data from the sensing; generating and transmitting a signal; or generating and transmitting data.

Another aspect of the invention is an integrated process for production of gasoline. In some embodiments, the process comprises separating a naphtha feed in a naphtha splitter into a light stream comprising $C_6$ and lighter boiling hydrocarbons, a $C_7$ stream comprising $C_7$ hydrocarbons, and a heavy stream comprising $C_8$ and heavier hydrocarbons. At least a portion of the light stream from the naphtha splitter is isomerized in a $C_5$-$C_6$ isomerization zone at isomerization conditions to form a $C_5$-$C_6$ isomerization effluent. The $C_7$ stream from the naphtha splitter is isomerized in a first $C_7$ isomerization zone at first isomerization conditions favoring the formation of multi-branched $C_7$ paraffins and cyclohexanes to form a first $C_7$ isomerization effluent. The first $C_7$ isomerization effluent is separated into an overhead stream comprising hydrogen and $C_4$ and lower boiling hydrocarbons and a second heavy stream comprising $C_5$ and heavier hydrocarbons. The second heavy stream is deisoheptanized in a deisoheptanizer into at least a first stream comprising multi-branched $C_7$ paraffins and a bottom stream comprising n-$C_7$ paraffins and $C_7$ cycloalkane hydrocarbons. The bottom stream from the deisoheptanizer and an aromatic-containing stream comprising at least one aromatic compound are introduced into the second $C_7$ isomerization zone and a flow rate of the aromatic-containing stream is controlled to control a temperature in the second $C_7$ isomerization zone. The bottom stream from the deisoheptanizer and the aromatic-containing stream are isomerized in a second $C_7$ isomerization zone at second isomerization conditions favoring the formation of cyclopentanes over cyclohexanes to form a second $C_7$ isomerization effluent. The heavy stream from the naphtha splitter is reformed in a reforming zone under reforming conditions forming a reformate effluent. One or more of: the $C_5$-$C_6$ isomerized stream, the first stream from the deisoheptanizer, the second $C_7$ isomerization effluent, or the reformate effluent are blended to form a gasoline blend.

In some embodiments, the aromatic-containing stream comprises at least one aromatic compound comprising at least one of benzene or toluene.

In some embodiments, the process further comprises introducing a cycloalkane-containing stream comprising at least one cycloalkane compound to the second $C_7$ isomerization zone.

In some embodiments, the cycloalkane-containing stream has a cyclopentanes/cycloalkanes molar ratio of about 1:2 or less.

In some embodiments, the first $C_7$ isomerization zone conditions include a temperature in a range of 40° C. to 235° C., or wherein the second $C_7$ isomerization zone conditions include a temperature in a range of 150° C. to 350° C., or both.

In some embodiments, the process further comprises hydroprocessing the naphtha feed before separating the naphtha feed.

In some embodiments, the $C_7$ stream from the naphtha splitter further comprises at least one aromatic compound, and the process further comprises hydrogenating at least a portion of the aromatic compounds in the $C_7$ stream from the naphtha splitter before isomerizing the $C_7$ stream from the naphtha splitter.

In some embodiments, the process further comprises separating the second $C_7$ isomerization effluent into a second overhead stream comprising hydrogen and $C_4$ and lower boiling hydrocarbons and a $C_7$ isomerized stream comprising $C_5$ and heavier hydrocarbons, and wherein blending one or more of: the at least the portion of the $C_5$-$C_6$ isomerization effluent, the first stream from the deisoheptanizer, at least the portion of the second $C_7$ isomerization effluent, or the reformate effluent, to form the gasoline blend comprises blending one or more of: the at least the portion of the $C_5$-$C_6$ isomerization effluent, the first stream from the deisoheptanizer, the $C_7$ isomerized stream, or the reformate effluent to form the gasoline blend.

In some embodiments, the process further comprises separating the $C_5$-$C_6$ isomerization effluent into a third overhead stream comprising hydrogen and $C_4$ and lower boiling hydrocarbons and a $C_5$-$C_6$ isomerized stream comprising $C_5$ and heavier hydrocarbons, and wherein blending one or more of: the at least the portion of the $C_5$-$C_6$ isomerization effluent, the first stream from the deisoheptanizer, the at least the portion of the second $C_7$ isomerization effluent, or the reformate effluent to form the gasoline blend comprises blending one or more of: at least a portion of the $C_5$-$C_6$ isomerized stream, the first stream from the deisoheptanizer, the at least the portion of the second $C_7$ isomerization effluent, or the reformate effluent to form the gasoline blend.

In some embodiments, the process further comprises mixing at least one additional stream with the gasoline blend.

FIG. 1 illustrates one example of a hydrocracker-based naphtha complex. The naphtha feed stream 105 is sent to a naphtha hydrotreater 110. The hydrotreated feed stream 115 is sent to a naphtha splitter 120 where it is separated into a light stream 125, a $C_7$ stream 130, and a heavy stream 135. The light stream 125 comprises $C_6$ and lighter boiling hydrocarbons, the $C_7$ stream 130 comprises $C_7$ hydrocarbons, and the heavy stream 135 comprises $C_5$ and heavier hydrocarbons.

The light stream 125 from the naphtha splitter 120 is sent to a $C_5$-$C_6$ isomerization zone 140 where the $C_6$ and lighter boiling hydrocarbons are isomerized to branched hydrocarbons forming the $C_5$-$C_6$ isomerization effluent 145.

The heavy stream 135 from the naphtha splitter 120 is reformed in reformer 150 to form reformate 155.

The $C_7$ stream 130 is sent to a $C_7$ isomerization zone 160 to form a $C_7$ isomerization effluent 165. The $C_7$ isomerization effluent 165 is sent to a deisoheptanizer 170 where it is separated into an overhead stream 175, a bottom stream 180, and a recycle stream 185. The overhead stream 175 comprises multi-branched $C_7$ hydrocarbons, and the bottom stream 180 comprises $C_7$ cycloalkanes and heavies.

The recycle stream 185 comprises n-heptane, single-branched $C_7$ paraffins and $C_7$ cycloalkanes and is recycled back to the $C_7$ isomerization zone 160.

The $C_5$-$C_6$ isomerization effluent 145, the overhead stream 175 from the deisoheptanizer 170, the bottom stream 180 from the deisoheptanizer 170, and the reformate 155 are combined to form a gasoline stream 190. Optionally, a $C_4$ stream 195 comprising n-$C_4$ and iso-$C_4$ paraffins can be included in the gasoline stream 190.

However, this arrangement involves increased capital and operating costs when producing high percentages of 95 RONC gasolines. To achieve the higher octanes, the recycle stream 185 is typically greater than or equal to the feed rate of the $C_7$ stream 130. As a result, the vessel size and amount of catalyst in the $C_7$ isomerization zone 160 and the size of the deisoheptanizer 170 become much larger in order to process the combined feed consisting of $C_7$ stream 130 and the recycle stream 185. The arrangement also results in much higher utility costs for the deisoheptanizer 170.

Figure 2:
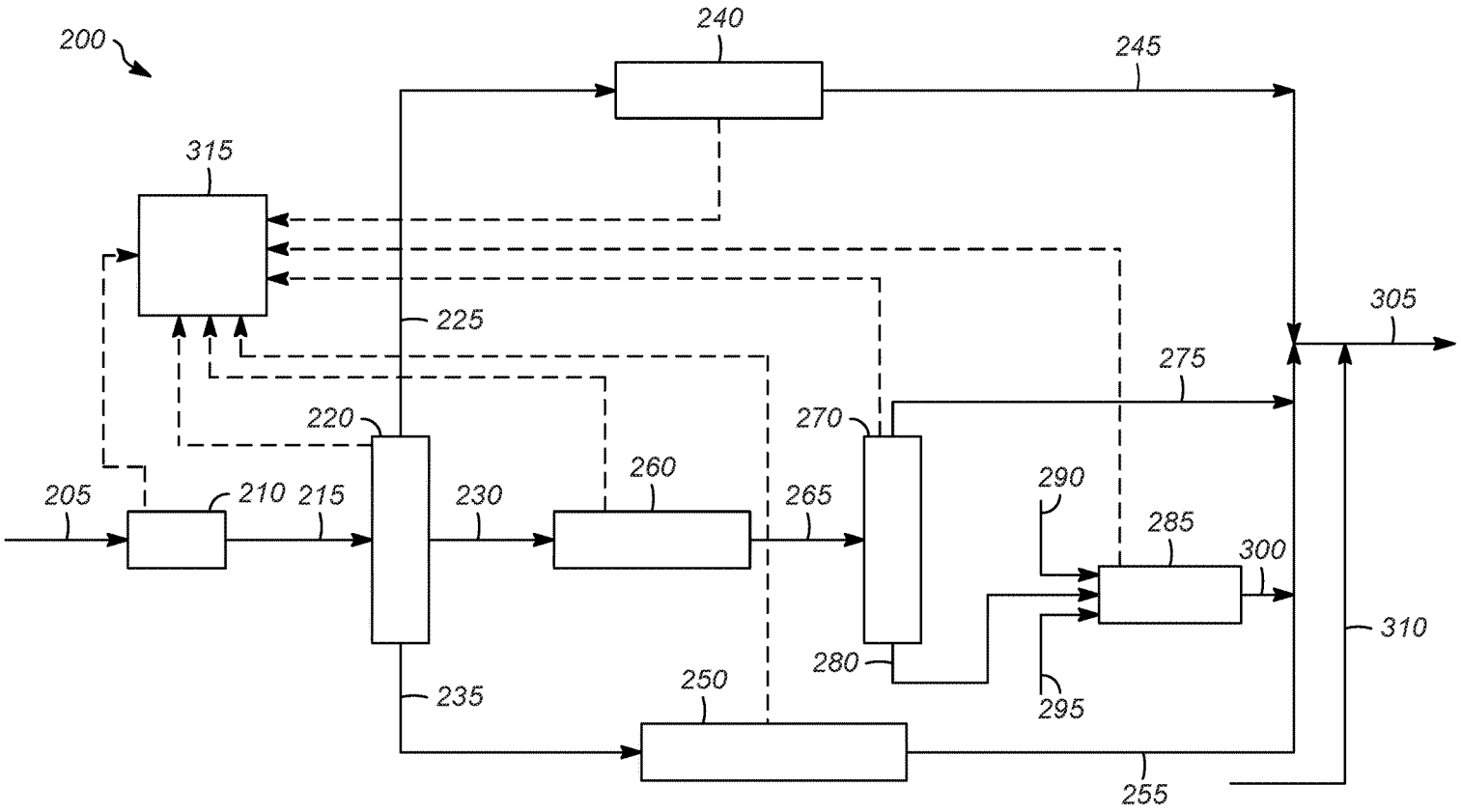
FIG. 2 is an illustration of one embodiment of the process of the present invention.

FIG. 2 illustrates one embodiment of an integrated complex of the present invention.

The naphtha feedstocks to the naphtha complex that can be used herein include hydrocarbons ranging from $C_4$ to $C_{12}$ consisting of normal paraffins, iso-paraffins, cycloalkanes and aromatics. The naphtha feedstock may also contain low concentrations of unsaturated hydrocarbons, sulfur-containing hydrocarbons, nitrogen-containing hydrocarbons, oxygen-containing hydrocarbons, metals and other impurities.

The naphtha feed stream 205 is sent to a naphtha hydrotreater 210. Hydrotreating is a process in which hydrogen gas is contacted with a hydrocarbon stream in the presence of suitable catalysts which are primarily active for the removal of oxygenates and heteroatoms, such as sulfur, nitrogen, and metals from the hydrocarbon feedstock. In hydrotreating, hydrocarbons with double and triple bonds may be saturated. Aromatics may also be saturated. Typical hydrotreating reaction conditions include a temperature of about 290° C. (550° F.) to about 455° C. (850° F.), a pressure of about 3.4 MPa (500 psig) to about 6.2 MPa (900 psig), a liquid hourly space velocity of about 0.5 $hr^{-1}$ to about 4 $hr^{-1}$, and a hydrogen rate of about 168 to about 1,011 $Nm^3/m^3$ oil (1,000-6,000 scf/bbl). Typical hydrotreating catalysts include at least one Group 8 metal, preferably iron, cobalt and nickel, and at least one Group 6 metal, preferably molybdenum and tungsten, on a high surface area support material, preferably alumina. Other typical hydrotreating catalysts include zeolitic catalysts, as well as noble metal catalysts where the noble metal is selected from palladium and platinum.

The hydrotreated feed stream 215 is sent to a naphtha splitter 220 where it is separated into a light stream 225, a $C_7$ stream 230, and a heavy stream 235. The light stream 225 comprises $C_6$ and lighter boiling hydrocarbons, the $C_7$ stream 230 comprises $C_7$ hydrocarbons, and the heavy stream 235 comprises $C_8$ and heavier hydrocarbons. The naphtha splitter 220 could comprise a divided wall column or two columns in series, for example. The light stream 225 from the naphtha splitter 220 is sent to a $C_5$-$C_6$ isomerization zone 240. The $C_5$-$C_6$ isomerization zone 240 can be any type of isomerization zone that takes a stream of $C_5$-$C_6$ straight-chain hydrocarbons or a mixture of straight-chain, branched-chain, and cycloalkane hydrocarbons and converts straight-chain hydrocarbons in the feed mixture to branched-chain hydrocarbons and branched hydrocarbons to more highly branched hydrocarbons, thereby producing an effluent having branched-chain and straight-chain hydrocarbons. The $C_5$-$C_6$ isomerization zone 240 can include one or more isomerization reactors, feed-effluent heat exchangers, inter-reactor heat exchangers, driers, sulfur guards, separator, stabilizer, compressors, deisopentanizer column, deisohexanizer column, recycle streams and other equipment as known in the art (not shown). A hydrogen-rich gas stream (not shown) is typically mixed with the light stream 225 and heated to reaction temperatures. The hydrogen-rich gas stream, for example, comprises about 50-100 mol % hydrogen. The hydrogen can be separated from the reactor effluent, compressed and recycled back to mix with the light stream 225.

The light stream 225 and hydrogen are contacted in the $C_5$-$C_6$ isomerization zone 240 with an isomerization catalyst forming $C_5$-$C_6$ isomerization effluent 245. The catalyst composites that can be used in the $C_5$-$C_6$ isomerization zone 240 include traditional isomerization catalysts including chlorided platinum alumina, crystalline aluminosilicates or zeolites, and other solid strong acid catalysts such as tungstated zirconia, sulfated zirconia and modified sulfated zirconia. Suitable catalyst compositions of this type will exhibit selective and substantial isomerization activity under the operating conditions of the process.

Another suitable isomerization catalyst is a solid strong acid catalyst that comprises a sulfated support of an oxide or hydroxide of a Group IVB (IUPAC 4) metal, preferably zirconium oxide or hydroxide, at least a first component that is a lanthanide element or yttrium component, and at least a second component being a platinum-group metal component. The catalyst optionally contains an inorganic-oxide binder, especially alumina.

The support material of the solid strong acid catalyst comprises an oxide or hydroxide of a Group IVB (IUPAC 4). In one embodiment the Group IVB element is zirconium or titanium. Sulfate is composited on the support material. A component of a lanthanide-series element is incorporated into the composite by any suitable means. The lanthanide series element component may be selected from the group consisting of lanthanum, cerium, praseodymium, neodymium, promethium, samarium, europium, gadolinium, terbium, dysprosium, holmium, erbium, thulium, ytterbium and lutetium. Suitable amounts of the lanthanide series element component are in the range of about 0.01 to about 10 wt % on an elemental basis, of the catalyst. A platinum-group metal component is added to the catalytic composite by any means known in the art to effect the catalyst, e.g., by impregnation. The platinum-group metal component may be selected from the group consisting of platinum, palladium, ruthenium, rhodium, iridium, or osmium. Amounts in the range of from about 0.01 to about 2 wt % platinum-group metal component, on an elemental basis are suitable.

Optionally, the catalyst is bound with a refractory inorganic oxide. The binder, when employed, usually comprises from about 0.1 to 50 wt %, preferably from about 5 to 20 wt %, of the finished catalyst. The support, sulfate, metal components and optional binder may be composited in any order effective to prepare a catalyst useful for the isomerization of hydrocarbons. Examples of suitable atomic ratios of lanthanide or yttrium to platinum-group metal for this catalyst are at least about 1:1; for example about 2:1 or greater; such as about 5:1 or greater. The catalyst may optionally further include a third component of iron, cobalt, nickel, rhenium or mixtures thereof. For example, iron may be present in amounts ranging from about 0.1 to about 5 wt % on an elemental basis. In an exemplary embodiment, the solid strong acid isomerization catalyst is sulfated zirconia or a modified sulfated zirconia.

Another class of suitable isomerization catalysts for use herein includes the chlorided platinum alumina catalysts. The aluminum is preferably an anhydrous gamma-alumina with a high degree of purity. The catalyst may also contain other platinum group metals. The term "platinum group metals" refers to noble metals excluding silver and gold that are selected from the group consisting of platinum, palladium, germanium, ruthenium, rhodium, osmium, and iridium. These metals demonstrate differences in activity and selectivity such that platinum has now been found to be the most suitable for this process. The catalyst will contain from about 0.1 to about 0.25 wt % of the platinum. Other platinum group metals may be present in a concentration of from about 0.1 to about 0.25 wt %. The platinum component may exist within the final catalytic composite as an oxide or halide or as an elemental metal. The presence of the platinum component in its reduced state has been found most suitable for this process. The chloride component termed in the art "a combined chloride" is present in an amount from about 2 to about 10 wt % based upon the dry support material. The use of chloride in amounts greater than about 5 wt % has been found to be the most beneficial for this process. The inorganic oxide preferably comprises alumina and more preferably gamma-alumina, eta-alumina, and mixtures thereof.

It is generally known that high chlorided platinum-alumina catalysts of this type are highly sensitive to sulfur and oxygen-containing compounds. Therefore, the use of such catalysts requires that the feedstock be relatively free of such compounds. A sulfur concentration no greater than about 0.5 ppm is generally required for use of high chloride platinum-alumina catalysts. The presence of sulfur in the feedstock serves to temporarily deactivate the catalyst by platinum poisoning. Activity of the catalyst may be restored by hot hydrogen stripping of sulfur from the catalyst composite or by lowering the sulfur concentration in the incoming feed to below about 0.5 ppm so that the hydrocarbon will desorb the sulfur that has been adsorbed on the catalyst. Water can act to permanently deactivate the catalyst by removing high activity chloride from the catalyst and replacing it with inactive aluminum hydroxide. Therefore, water, as well as oxygenates, in particular $C_1$-$C_5$ oxygenates, that can decompose to form water, can only be tolerated in very low concentrations. In general, this requires a limitation of oxygenates in the feed to about 0.1 ppm or less. The feedstock may be treated by any method that will remove water and sulfur compounds. Sulfur may be removed from the feedstock stream by hydrotreating. A variety of commercial dryers are available to remove water from the feed components. Adsorption processes for the removal of sulfur and water from hydrocarbon streams are also well known to those skilled in the art.

Operating conditions within the isomerization zone are selected to maximize the production of isoalkane product from the feed components. Temperatures within the isomerization zone will usually range from about 40° C. to about 235° C. (104° F. to 455° F.). Lower reaction temperatures usually favor equilibrium mixtures of isoalkanes versus normal alkanes. Lower temperatures are particularly useful in processing feeds composed of $C_5$ and $C_6$ alkanes where the lower temperatures favor equilibrium mixtures having the highest concentration of the most branched isoalkanes. When the feed mixture is primarily $C_5$ and $C_6$ alkanes, temperatures in the range of from about 60° C. to about 160° C. are suitable. The isomerization zone may be maintained over a wide range of pressures. Pressure conditions in the isomerization of $C_4$-$C_6$ paraffins range from about 700 kPa(a) to about 7000 kPa(a). In other embodiments, pressures for this process are in the range of from about 2000 kPa(g) to 5000 kPa(g). The feed rate to the reaction zone can also vary over a wide range. These conditions include liquid hourly space velocities ranging from about 0.5 to about 12 $hr^{-1}$ however, with some embodiments having space velocities between about 1 and about 6 $hr^{-1}$.

The heavy stream 235 from the naphtha splitter 220 is sent to reformer 250 to form reformate 255. In a common form, the reforming process can employ catalyst particles in several reaction zones interconnected in a series flow arrangement. Typically, a heavy naphtha stream and a hydrogen gas stream are preheated and charged to a reforming zone containing typically two to five reactors in series. Suitable heating means are provided between reactors to compensate for the net endothermic heat of reaction in each of the reactors. Reactants may contact the catalyst in individual reactors in either upflow, downflow, or radial flow fashion, with the radial flow mode being preferred. The catalyst may be contained in a fixed-bed system or, preferably, in a moving-bed system with associated continuous catalyst regeneration. Alternative approaches to reactivation of deactivated catalyst include semiregenerative operation, which includes shutting down the entire unit for catalyst regeneration and reactivation, or swing-reactor operation, which includes isolating a single reactor from the system, regenerating and reactivating while the other reactors remain on stream. Typically, continuous catalyst regeneration in conjunction with a moving-bed system is disclosed, inter alia, in, e.g., U.S. Pat. Nos. 3,647,680; 3,652,231; 3,692,496; and 4,832,921.

Generally, effluent from the reforming zone is passed through a cooling means to a separation zone, often maintained at about 0-about 65° C., where a hydrogen gas stream is separated from a liquid stream commonly called "unstabilized reformate". The resultant hydrogen stream can then be recycled through suitable compressing means back to the reforming zone. Usually, the liquid phase from the separation zone is withdrawn and processed in a fractionating system in order to adjust the butane concentration, thereby controlling front-end volatility of the resulting reformate.

The reforming reactors can contain any suitable catalyst. The catalyst particles are typically comprised of one or more Group VIII (IUPAC 8-10) noble metals (e.g., platinum, iridium, rhodium, and palladium) and a halogen combined with a porous carrier, such as a refractory inorganic oxide. U.S. Pat. No. 2,479,110, for example, teaches an alumina-platinum-halogen reforming catalyst. Although the catalyst may contain about 0.05 to about 2.0 wt % of Group VIII metal, a less expensive catalyst, such as a catalyst containing about 0.05 to about 0.5 wt % of Group VIII metal may be used. In addition, the catalyst may contain indium and/or a lanthanide series metal such as cerium. The catalyst particles may also contain one or more Group IVA (IUPAC 14) metals (e.g., tin, germanium, and lead), such as described in U.S. Pat. Nos. 4,929,333, 5,128,300, and the references cited therein. The halogen is typically chlorine, and alumina is commonly the carrier. Suitable alumina materials include, but are not limited to, gamma, eta, and theta alumina. One property related to the performance of the catalyst is the surface area of the carrier. Preferably, the carrier has a surface area of about 100 to about 500 $m^2/g$. The activity of catalysts having a surface area of less than about 130 $m^2/g$ tend to be more detrimentally affected by catalyst coke than catalysts having a higher surface area. Generally, the particles are usually spheroidal and have a diameter of about 1.6 to about 3.1 mm (about 1/16 to about 1/8 inch), although they may be as large as about 6.35 mm (about 1/4 inch) or as small as about 1.06 mm (about 1/24 inch). In a particular reforming reaction zone, however, it is desirable to use catalyst particles which fall in a relatively narrow size range.

Typical feed inlet temperature for the reformers are between 440 and 580° C. (824 and 1076° F.), or between 500 and 580° C. (932 and 1076° F.), or between 540 and 580° C. (1004 and 1076° F.), or at least above 540° C. (932° F.). The reformer reactors may have different operating temperatures, for example, with a first reforming reactor having a temperature between 500 to 540° C. (932 to 1004° F.) and a second, subsequent reforming reactor having a temperature greater than 540° C. (1004° F.). The reformers can be operated at a range of pressures generally from atmospheric pressure of about 0 to about 6,895 kPa(g) (about 0 psig to about 1,000 psig), or about 276 to about 1,379 kPa(g) (about 40 to about 200 psig). The reaction conditions also include a liquid hour space velocity (LHSV) in the range from 0.6 $hr^{-1}$ to 10 $hr^{-1}$. Preferably, the LHSV is between 0.6 $hr^{-1}$ and 5 $hr^{-1}$, with a more preferred value between 1 $hr^{-1}$ and 5 $hr^{-1}$, and with a most preferred value between 2 $hr^{-1}$ and 5 $hr^{-1}$. The shorter residence time is especially preferred when utilizing the higher temperatures. The catalyst also has a residence time in the reformers of between 0.5 hours and 36 hours.

The $C_7$ stream 230 is sent to a first $C_7$ isomerization zone 260 to form a first $C_7$ isomerization effluent 265. The first $C_7$ isomerization zone 260 is operated under conditions favoring the formation of multi-branched $C_7$ paraffins and cyclohexanes.

The catalyst composites that can be used in the first $C_7$ isomerization zone 260 include traditional isomerization catalysts including chlorided platinum alumina, crystalline aluminosilicates or zeolites, and other solid strong acid catalysts such as tungstated zirconia, sulfated zirconia and modified sulfated zirconia. Suitable catalyst compositions of this type will exhibit selective and substantial isomerization activity under the operating conditions of the process.

Operating conditions within the first $C_7$ isomerization zone 260 are selected to favor the formation of multi-branched $C_7$ paraffins and cyclohexanes. Temperatures within the first $C_7$ isomerization zone 260 will usually range from about 40° C. to about 235° C. (104° F. to 455° F.), with reactor inlet temperatures ranging from about 80° C. to 130° C., or from about 90° C. to 120° C. The lower reaction temperatures will favor higher equilibrium mixtures of multi-branched $C_7$ paraffins, will reduce the hydrocracking of $C_7$ paraffins to undesired $C_5^-$ light ends, and favor the formation of cyclohexanes. In some embodiments, it is advantageous to keep the temperature rise in the $C_7$ isomerization zone 260 less than about 55° C. to prevent excessive hydrocracking of $C_7$ paraffins which leads to light ends and loss of $C_5^+$ gasoline yields. The benzene and toluene levels should be kept as low as possible in $C_7$ stream 230 to prevent significant exotherms within $C_7$ isomerization zone 260. For high aromatics-containing feeds, the $C_7$ stream 230 can be mixed with a hydrogen-rich gas stream (as described above) and processed in an aromatic hydrogenation unit that utilizes a suitable aromatic hydrogenation catalyst that results in aromatic saturation with little or no hydrocracking activity so as to prevent yield losses to $C_5-$ light ends. By removing the aromatic saturation from the first $C_7$ isomerization zone 260, the large exotherm due to high aromatics is removed, thus allowing first $C_7$ isomerization zone 260 to operate at the desired lower temperatures. The effluent from the aromatic hydrogenation unit is then fed to the first $C_7$ isomerization zone 260.

The first $C_7$ isomerization zone 260 may be maintained over a wide range of pressures. Pressure conditions range from about 700 kPa(a) to about 7000 kPa(a). In other embodiments, pressures range from about 1800 kPa(a) to 3200 kPa(a). The feed rate to the first $C_7$ isomerization zone 260 can also vary over a wide range. These conditions include liquid hourly space velocities ranging from about 0.5 to about 12 $hr^{-1}$, with some embodiments having liquid hourly space velocities between about 1 and about 6 $hr^{-1}$. The first $C_7$ isomerization effluent 265 is sent to a deisoheptanizer 270 where it is separated into an overhead stream 275, and a bottom stream 280. The overhead stream 275 comprises multi-branched $C_7$ hydrocarbons, and the bottom stream 280 comprises n-$C_7$ and $C_7$ cycloalkanes.

The bottom stream 280 is sent to the second $C_7$ isomerization zone 285. The second $C_7$ isomerization zone 285 is operated under conditions favoring the formation of cyclopentanes over cyclohexanes.

The catalyst composites that can be used in the second $C_7$ isomerization zone 285 include traditional isomerization catalysts including chlorided platinum alumina, crystalline aluminosilicates or zeolites, and other solid strong acid catalysts such as tungstated zirconia, sulfated zirconia and modified sulfated zirconia. Suitable catalyst compositions of this type will exhibit selective and substantial isomerization activity under the operating conditions of the process.

Operating conditions within the second $C_7$ isomerization zone 285 are selected to favor the formation of cyclopentanes over cyclohexanes. Temperatures within the second $C_7$ isomerization zone 285 will usually range from about 150° C. to 350° C., with reactor outlet temperatures typically above about 200° C.

The second $C_7$ isomerization zone 285 may be maintained over a wide range of pressures. Pressure conditions range from about 700 kPa(a) to about 7000 kPa(a). In other embodiments, pressures range from about 1800 kPa(a) to 3200 kPa(a). The feed rate to the $C_7$ isomerization zone 285 can also vary over a wide range. These conditions include liquid hourly space velocities ranging from about 0.5 to about 12 $hr^{-1}$, with some embodiments having liquid hourly space velocities between about 1 and about 6 $hr^{-1}$.

An aromatic-containing stream 290 is introduced into the second $C_7$ isomerization zone 285. The aromatic-containing stream comprises at least one aromatic compound, typically in the range of 0.1 wt-100 wt %, or 0.1-90 wt %, or 0.1-80 wt %, or 0.1-70 wt %, or 0.1-60 wt %, or 0.1-50 wt %, or 1-100 wt %, or 1-90 wt %, or 1-80 wt %, or 1-70 wt %, or 1-60 wt %, or 1-50 wt %, or 5-100 wt %, or 5-90 wt %, or 5-80 wt %, or 5-70 wt %, or 5-60 wt %, or 5-50 wt %, or 10-100 wt %, or 10-90 wt %, or 10-80 wt %, or 10-70 wt %, or 10-60 wt %, or 10-50 wt %, or 15-100 wt %, or 15-90 wt %, or 15-80 wt %, or 15-70 wt %, or 15-60 wt %, or 15-50 wt %, or 20-100 wt %, or 20-90 wt %, or 20-80 wt %, or 20-70 wt %, or 20-60 wt %, or 20-50 wt %. For embodiments with more than one isomerization reactor in the second $C_7$ isomerization zone 285, the aromatic stream can be preferentially fed to any one or more of the reactors. As discussed above, the saturation of the aromatics in the second $C_7$ isomerization zone 285 provides heat that moderates the temperature drop in the isomerization reactors such as to produce a higher exit reactor temperature. This results in a higher equilibrium conversion to the higher octane cyclopentanes. The aromatic-containing stream 290 can be any aromatic-containing stream, including, but not limited to, light reformate from a reformate splitter (not shown) in reformer 250, a benzene-containing stream fractionated from the naphtha splitter 220, a toluene-containing stream fractionated from the naphtha splitter 220, or other sources.

A cycloalkane-containing stream 295 can also be introduced into the second $C_7$ isomerization zone 285, if desired. The cycloalkane-containing stream comprises of at least one cycloalkane, typically in the range of 0.1 wt-100 wt %, or 0.1-90 wt %, or 0.1-80 wt %, or 0.1-70 wt %, or 0.1-60 wt %, or 0.1-50 wt %, or 1-100 wt %, or 1-90 wt %, or 1-80 wt %, or 1-70 wt %, or 1-60 wt %, or 1-50 wt %, or 5-100 wt %, or 5-90 wt %, or 5-80 wt %, or 5-70 wt %, or 5-60 wt %, or 5-50 wt %, or 10-100 wt %, or 10-90 wt %, or 10-80 wt %, or 10-70 wt %, or 10-60 wt %, or 10-50 wt %, or 15-100 wt %, or 15-90 wt %, or 15-80 wt %, or 15-70 wt %, or 15-60 wt %, or 15-50 wt %, or 20-100 wt %, or 20-90 wt %, or 20-80 wt %, or 20-70 wt %, or 20-60 wt %, or 20-50 wt %. The cycloalkane-containing stream preferably has a cyclopentanes/cycloalkanes molar ratio of about 1:2 or less. Streams with higher molar ratios already contain high levels of cyclopentanes, and thus they are typically blended directly with the gasoline stream. The cycloalkane-containing stream 295 can be any suitable cycloalkane-containing stream, including, but not limited to a bottoms cut from a deisohexanizer column, or a cycloalkane-containing straight run naphtha stream.

The first and second $C_7$ isomerization zones 260, 285 can include one or more isomerization reactors, feed-effluent heat exchangers, inter-reactor heat exchangers, driers, sulfur guards, separator, stabilizer, compressors and other equipment as known in the art (not shown). A hydrogen-rich gas stream (not shown) (as described above) is typically mixed with the stream 230 and with stream 280 and heated to reaction temperatures. The hydrogen can be separated from the reactor effluents, compressed and recycled back to mix with streams 230 and/or 280.

The catalysts used in the first and second $C_7$ isomerization zones 260, 285 can be those described above with respect to the $C_5$-$C_6$ isomerization zone 240.

The $C_5$-$C_6$ isomerization zone effluent 245, the overhead stream 275 from the deisoheptanizer 270, the second $C_7$ isomerization effluent 300, and the reformate 255 are combined to form a gasoline stream 305. Optionally, one or more additional streams 310 could also be included in the gasoline stream 305. For example, the additional stream 310 could be a $C_4$ stream comprising n-$C_4$ and iso-$C_4$ paraffins.

One or more of the naphtha hydrotreater 210, the naphtha splitter 220, the $C_5$-$C_6$ isomerization zone 240, the reforming zone 250, the first $C_7$ isomerization zone 260, the deisohexanizer 270, and the second $C_7$ isomerization zone 285 can be connected to controller 315 which can be used to monitor and control the various processes.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

EXAMPLES

A case study was done for a hydrocracker based refinery using a naphtha feed stream 105 of 57,400 BPD to hydrotreater 110. The naphtha feed was derived from Saharan crude blend including full range straight run naphtha and full range naphtha from a hydrocracker. The same feed was used for all cases. Example 1 was the base case developed using the configuration shown in FIG. 1. Example 2 is the improved process configuration shown in FIG. 2. All the studies were developed using detailed kinetic models and process simulations. A summary of this study is shown in Table 1. Table 1 shows the flow rates for Example 1 and Example 2 with same fresh feed to the first $C_7$ isomerization zone (stream 130 in FIG. 1 and stream 230 in FIG. 2). As described above, the invention has eliminated the recycle stream 185 from deisoheptanizer 170 in FIG. 1. As a result, the volumetric feed rate to the first $C_7$ isomerization zone 260 has been reduced by 55.9%, and the volumetric feed rate to deisoheptanizer 270 was reduced by 57.5%.

The process according to the invention shows a 3.5 lv % increase of $C_7$ isomerate product (streams 275 and 300) in FIG. 2, as compared to the base case (streams 175 and 180) in FIG. 1. The process according to the invention shows a 4.0% octane barrel increase. As a result, the percent of 95 RONC produced increases from 77 lv % to 83 lv % as compared to the base case. More importantly, the total gasoline produced was also increased by 0.6 lv %.

The $C_7$ isomerization section (including first $C_7$ isomerization zone 260, second $C_7$ isomerization zone 285, and deisoheptanizer 270) in FIG. 2 according to the invention shows a capital cost reduction by 11% due to the elimination of recycle stream 185, despite the addition of the second $C_7$ isomerization zone 285. Moreover, the flow scheme according to the invention (Example 2) shows an operating cost reduction of 57% as compared to the base case (Example 1).

zone 285 without any aromatics addition. Example 4 uses the same flow rate and composition of stream 280, but with toluene stream 290 introduced into the second $C_7$ isomerization zone 285. Example 3 and Example 4 used the same inlet temperature of the second $C_7$ isomerization zone 285.

Example 3 shows a temperature drop of 19.8° F. across the second $C_7$ isomerization zone 285. The dimethylcyclopentanes to $C_7$ cycloalkanes ratio increased from 1.4% to 46.8%, resulting in a large RONC increase of stream 280 before and after the second $C_7$ isomerization zone 285. In Example 4, two toluene (stream 290) to hydrocarbon (stream 280) volume flow ratios of 0.075 and 0.15 were

TABLE 1

Case study summary with no aromatics to zone 285

| Stream Information | Example 1 FIG. 1 | Example 2 FIG. 2 | % Change |
|---|---|---|---|
| $C_7$ fresh feed, BPD | 12,332 (stream 130) | 12,332 (stream 230) | |
| Recycle stream from deisoheptanizer, BPD | 15,641 (stream 185) | 0 | |
| Hydrocarbon feed to the first $C_7$ isomerization zone, BPD | 27,972 (stream to zone 160) | 12,332 (stream to zone 260) | −55.9% |
| Feed to deisoheptanizer, BPD | 26,524 (stream 165) | 11,260 (stream 265) | −57.5% |
| Feed to second $C_7$ isomerization zone, BPD | 0 | 3,492 (stream 280) | |
| $C_7$ Isomerization Products | | | |
| Deisoheptanizer overhead, BPD | 8,510 (stream 175) | 7,768 (stream 275) | |
| Deisoheptanizer bottom or second $C_7$ isomerization effluent, BPD | 2,373 (stream 180) | 3,492 (stream 300) | |
| Total $C_7$ product, BPD | 10,883 | 11,260 | +3.5% |
| Deisoheptanizer overhead RONC | 79.7 | 78.6 | |
| Deisoheptanizer bottom or second $C_7$ isomerization effluent RONC | 71.8 | 77.8 | |
| Total octane barrels | 100% (base) | 104% (relative to base) | +4.0% |
| Final Gasoline Products | | | |
| 91 RONC, BPD | 11,707 | 8,582 | |
| 95 RONC, BPD | 39,205 | 42,638 | |
| Percentage of 95 RONC gasoline | 77 lv% | 83 lv% | |
| Total gasoline produced, BPD | 50,912 | 51,220 | +0.6% |
| EEC Cost | | | |
| First $C_7$ isomerization zone and deisoheptanizer | 100% (base) | 67% (relative to base) | |
| Second $C_7$ isomerization zone | 0 | 22% (relative to base) | |
| Total reactor and deisoheptanizer | 100% (base) | 89% (relative to base) | −11% |
| Operating Cost in $C_7$ Isomerization | 100% (base) | 43% (relative to base) | −57% |

Another case study was conducted to study the effect of aromatics addition to the second $C_7$ isomerization zone 285. The results are summarized in Table 2. Stream 280 comprises 76 mol % of methylcyclohexane and 12.5 mol % n-heptane. The dimethylcyclopentanes to $C_7$ cycloalkanes ratio in stream 280 is only 0.014 mole ratio. Therefore, the RONC of stream 280 is only 65.8. Example 3 shows the octane and dimethylcyclopentanes to $C_7$ cycloalkanes ratio of stream 280 were upgraded by the second $C_7$ isomerization studied. As shown in Table 2, the saturation of the aromatics in the second $C_7$ isomerization zone 285 provides heat and results in higher reactor outlet temperatures. With a toluene to hydrocarbon volume flow ratio of 0.075, instead of temperature drop, there was a temperature rise due to heat release of aromatics saturation. This results in a higher equilibrium conversion to the higher octane cyclopentanes-containing hydrocarbon product with higher product RONCs due to higher outlet temperature in the second $C_7$ isomerization zone 285.

TABLE 2

Case study of second $C_7$ isomerization zone 285 with aromatics addition in FIG. 2

| | Feed Stream 280 | Example 3 | Example 4 | |
|---|---|---|---|---|
| Toluene/Hydrocarbon volume flow ratio | — | 0.0 | 0.075 | 0.150 |
| Reactor delta T (outlet-inlet), ° F. | — | −19.8 | 34.1 | 52.4 |
| RONC of feed stream 280 | 65.8 | 65.8 | 65.8 | 65.8 |
| RONC of stream 300 exiting zone 285 | — | 78.1 | 79.9 | 81.9 |
| Dimethylcyclopentanes/$C_7$ cycloalkanes mole ratio in feed stream 280 | 0.014 | 0.014 | 0.014 | 0.014 |
| Dimethylcyclopentanes/$C_7$ cycloalkanes mole ratio in stream 300 | — | 0.468 | 0.545 | 0.562 |

Another study was conducted to understand the effect of the cycloalkane content of stream 280 on the temperature changes in the second $C_7$ isomerization zone 285. The $C_7$ isomerization zones 260 and 285 each consisted of two reactors in series loaded with platinum chlorided alumina catalyst. Table 3 shows the molar ratio of cyclopentanes/cycloalkanes at the reactor 1 inlets and the reactor 2 outlets. The conditions, feeds and products to and from zone 260 were held constant while the separation in the deisoheptanizer zone 270 was varied. The separation in zone 270 was adjusted to increase the recovery of the multi-branched $C_7$ paraffins into stream 275.

cyclopentanes/cycloalkanes at the reactor 1 inlets of zone 285 decrease from 23 mol % to 3 mol %. Table 3 shows that there was a net delta temperature change of +11° F. and +5° F. for reactors 1 and 2 at recovery ratio of 0.65 while there was a net delta temperature change of −22° F. and −10° F. for reactors 1 and 2 at recovery ratio of 0.99. Based on these temperature changes, the addition of an aromatic-containing stream to zone 285 to reactor 1 and/or reactor 2 inlets will be advantageous for cycloalkane contents of about 65 mol % and greater where endotherms occur. However, for cases with relatively small exotherms, the addition of an aromatic-containing stream can still be advantageous for cycloalkane contents greater than about 56 mol % if the total exotherm is limited to about 55° C. (about 100° F.).

TABLE 3

Study of cycloalkane content and reactor temperatures

| Recovery of Multi-Branched $C_7$ Paraffins, mole fraction in Stream 275 | $C_7$ Isom Zone | Total Cycloalkane in Feed to Each Reactor, mol % | Reactors in Isom Zone | Cyclopentanes/ Cycloalkanes mol % | Reactor | Rx Inlet Temp ° F. | Rx Outlet Temp ° F. | Delta Temp ° F. |
|---|---|---|---|---|---|---|---|---|
| | 260 | 43% | Rx1 inlet | 47% | 1 | 248 | 356 | +108 |
| | | 46% | Rx2 outlet | 36% | 2 | 257 | 276 | +19 |
| 0.65 | 285 | 56% | Rx1 inlet | 23% | 1 | 350 | 361 | +11 |
| | | 63% | Rx2 outlet | 55% | 2 | 450 | 455 | +5 |
| 0.80 | 285 | 61% | Rx1 inlet | 18% | 1 | 350 | 356 | +6 |
| | | 67% | Rx2 outlet | 54% | 2 | 450 | 450 | 0 |
| 0.85 | 285 | 63% | Rx1 inlet | 15% | 1 | 350 | 353 | +3 |
| | | 68% | Rx2 outlet | 53% | 2 | 450 | 448 | −2 |
| 0.90 | 285 | 66% | Rx1 inlet | 11% | 1 | 350 | 347 | −3 |
| | | 70% | Rx2 outlet | 53% | 2 | 450 | 444 | −6 |
| 0.95 | 285 | 71% | Rx1 inlet | 8% | 1 | 350 | 340 | −10 |
| | | 74% | Rx2 outlet | 52% | 2 | 450 | 440 | −10 |
| 0.99 | 285 | 78% | Rx1 inlet | 3% | 1 | 350 | 328 | −22 |
| | | 80% | Rx2 outlet | 51% | 2 | 450 | 440 | −10 |

Table 3 shows for the first $C_7$ isomerization zone 260 that the cyclopentanes/cycloalkanes ratio decreases from 47 mol % in the feed to reactor 1 to 36 mol % in the effluent from reactor 2. This makes the separation in the deisoheptanizer zone 270 easier due to the higher boiling point of methylcyclohexane, as compared to multi-branched $C_7$ paraffins and dimethylcyclopentanes.

As the multi-branched $C_7$ paraffin recovery in stream 275 from deisoheptanizer zone 270 increases from 0.65 to 0.99 mole fraction, there is an increase in the total cycloalkane content from 56 mol % to 78 mol % in stream 280 (see reactor 1 inlets in Table 3 for zone 285), and the ratio of By about, we mean within 10% of the stated value, or 5%, or 1%.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

Specific Embodiments

While the following is described in conjunction with specific embodiments, it will be understood that this description is intended to illustrate and not limit the scope of the preceding description and the appended claims.

A first embodiment of the invention is an integrated process for production of gasoline comprising separating a naphtha feed in a naphtha splitter into a light stream comprising $C_6$ and lighter boiling hydrocarbons, a $C_7$ stream comprising $C_7$ hydrocarbons, and a heavy stream comprising $C_8$ and heavier hydrocarbons; isomerizing at least a portion of the light stream from the naphtha splitter in a $C_5$-$C_6$ isomerization zone at isomerization conditions to form a $C_5$-$C_6$ isomerization effluent; isomerizing the $C_7$ stream from the naphtha splitter in a first $C_7$ isomerization zone at first isomerization conditions favoring the formation of multi-branched $C_7$ paraffins and cyclohexanes to form a first $C_7$ isomerization effluent; deisoheptanizing at least a portion of the first $C_7$ isomerization effluent in a deisoheptanizer into at least a first stream comprising multi-branched $C_7$ paraffins and a bottom stream comprising n-$C_7$ paraffins and $C_7$ cycloalkane hydrocarbons; introducing the bottom stream from the deisoheptanizer and an aromatic-containing stream comprising at least one aromatic compound into the second $C_7$ isomerization zone and controlling a flow rate of the aromatic-containing stream to control a temperature in the second $C_7$ isomerization zone; isomerizing the bottom stream from the deisoheptanizer and the aromatic-containing stream in a second $C_7$ isomerization zone at second isomerization conditions favoring the formation of cyclopentanes over cyclohexanes to form a second $C_7$ isomerization effluent; reforming the heavy stream from the naphtha splitter in a reforming zone under reforming conditions forming a reformate effluent; blending one or more of: at least a portion of: the $C_5$-$C_6$ isomerization effluent, the first stream from the deisoheptanizer, at least a portion of the second $C_7$ isomerization effluent, or the reformate effluent to form the gasoline blend. An embodiment of the invention is one, any or all of prior embodiments in this paragraph up through the first embodiment in this paragraph wherein the aromatic-containing stream comprises at least one of benzene or toluene. An embodiment of the invention is one, any or all of prior embodiments in this paragraph up through the first embodiment in this paragraph further comprising introducing a cycloalkane-containing stream comprising at least one cycloalkane compound to the second $C_7$ isomerization zone. An embodiment of the invention is one, any or all of prior embodiments in this paragraph up through the first embodiment in this paragraph wherein the cycloalkane-containing stream has a cyclopentanes/cycloalkanes molar ratio of about 1:2 or less. An embodiment of the invention is one, any or all of prior embodiments in this paragraph up through the first embodiment in this paragraph further comprising hydroprocessing the naphtha feed before separating the naphtha feed. An embodiment of the invention is one, any or all of prior embodiments in this paragraph up through the first embodiment in this paragraph wherein the $C_7$ stream from the naphtha splitter further comprises at least one aromatic compound, and further comprising hydrogenating at least a portion of the aromatic compounds in the $C_7$ stream from the naphtha splitter before isomerizing the $C_7$ stream from the naphtha splitter. An embodiment of the invention is one, any or all of prior embodiments in this paragraph up through the first embodiment in this paragraph further comprising separating the first $C_7$ isomerization effluent into an overhead stream comprising hydrogen and $C_4$ and lower boiling hydrocarbons and a second heavy stream comprising $C_5$ and heavier hydrocarbons before deisoheptanizing at least the portion of the first $C_7$ isomerization effluent, and wherein deisoheptanizing at least the portion of the first $C_7$ isomerization effluent comprises deisoheptanizing the second heavy stream. An embodiment of the invention is one, any or all of prior embodiments in this paragraph up through the first embodiment in this paragraph further comprising separating the second $C_7$ isomerization effluent into a second overhead stream comprising hydrogen and $C_4$ and lower boiling hydrocarbons and a $C_7$ isomerized stream comprising $C_5$ and heavier hydrocarbons, and wherein blending one or more of: the at least the portion of the $C_5$-$C_6$ isomerization effluent, the first stream from the deisoheptanizer, the at least the portion of the second $C_7$ isomerization effluent, or the reformate effluent to form the gasoline blend comprises blending one or more of: the at least the portion of the $C_5$-$C_6$ isomerization effluent, the first stream from the deisoheptanizer, the $C_7$ isomerized stream, or the reformate effluent to form the gasoline blend. An embodiment of the invention is one, any or all of prior embodiments in this paragraph up through the first embodiment in this paragraph further comprising separating the $C_5$-$C_6$ isomerization effluent into a third overhead stream comprising hydrogen and $C_4$ and lower boiling hydrocarbons and a $C_5$-$C_6$ isomerized stream comprising $C_5$ and heavier hydrocarbons, and wherein blending one or more of: the at least the portion of the $C_5$-$C_6$ isomerization effluent, the first stream from the deisoheptanizer, the at least the portion of the second $C_7$ isomerization effluent, or the reformate effluent to form the gasoline blend comprises blending one or more of: at least a portion of the $C_5$-$C_6$ isomerized stream, the first stream from the deisoheptanizer, the at least the portion of the second $C_7$ isomerization effluent, or the reformate effluent to form the gasoline blend. An embodiment of the invention is one, any or all of prior embodiments in this paragraph up through the first embodiment in this paragraph wherein the first isomerization conditions include a temperature in a range of 40° C. to 235° C., or wherein the second isomerization conditions include a temperature in a range of 150° C. to 350° C., or both. An embodiment of the invention is one, any or all of prior embodiments in this paragraph up through the first embodiment in this paragraph further comprising mixing at least one additional stream with the gasoline blend. An embodiment of the invention is one, any or all of prior embodiments in this paragraph up through the first embodiment in this paragraph, further comprising at least one of sensing at least one parameter of the process and generating a signal or data from the sensing; generating and transmitting a signal; or generating and transmitting data.

A second embodiment of the invention is an integrated process for production of gasoline comprising separating a naphtha feed in a naphtha splitter into a light stream comprising $C_6$ and lighter boiling hydrocarbons, a $C_7$ stream comprising $C_7$ hydrocarbons, and a heavy stream comprising $C_8$ and heavier hydrocarbons; isomerizing at least a portion of the light stream from the naphtha splitter in a $C_5$-$C_6$ isomerization zone at isomerization conditions to form a $C_5$-$C_6$ isomerization effluent; isomerizing the $C_7$ stream from the naphtha splitter in a first $C_7$ isomerization zone at first isomerization conditions favoring the formation of multi-branched $C_7$ paraffins and cyclohexanes to form a first $C_7$ isomerization effluent; separating the first $C_7$ isomerization effluent into an overhead stream comprising hydrogen and $C_4$ and lower boiling hydrocarbons and a second heavy stream comprising $C_5$ and heavier hydrocarbons; deisoheptanizing the second heavy stream in a deisoheptanizer into at least a first stream comprising multi-branched $C_7$ paraffins and a bottom stream comprising n-$C_7$ paraffins and $C_7$ cycloalkane hydrocarbons; introducing the bottom stream from the deisoheptanizer and an aromatic-containing stream comprising at least one aromatic compound into the second $C_7$ isomerization zone and controlling a flow rate of the aromatic-containing stream to control a temperature in the second $C_7$ isomerization zone; isomerizing the bottom stream from the deisoheptanizer and the aromatic-containing stream in a second $C_7$ isomerization zone at second isomerization conditions favoring the formation of cyclopentanes over cyclohexanes to form a second $C_7$ isomerization effluent; reforming the heavy stream from the naphtha splitter in a reforming zone under reforming conditions forming a reformate effluent; blending one or more of: at least a portion of the $C_5$-$C_6$ isomerization effluent, the first stream from the deisoheptanizer, at least a portion of the second $C_7$ isomerization effluent, or the reformate effluent to form the gasoline blend. An embodiment of the invention is one, any or all of prior embodiments in this paragraph up through the second embodiment in this paragraph wherein the at least one aromatic compound comprises at least one of benzene or toluene. An embodiment of the invention is one, any or all of prior embodiments in this paragraph up through the second embodiment in this paragraph further comprising introducing a cycloalkane-containing stream comprising at least one cycloalkane compound to the second $C_7$ isomerization zone. An embodiment of the invention is one, any or all of prior embodiments in this paragraph up through the second embodiment in this paragraph wherein the cycloalkane-containing stream has a cyclopentanes/cycloalkanes molar ratio of about 1:2 or less. An embodiment of the invention is one, any or all of prior embodiments in this paragraph up through the second embodiment in this paragraph wherein the first isomerization conditions include a temperature in a range of 40° C. to 235° C., or wherein the second isomerization conditions include a temperature in a range of 150° C. to 350° C., or both. An embodiment of the invention is one, any or all of prior embodiments in this paragraph up through the second embodiment in this paragraph further comprising hydroprocessing the naphtha feed before separating the naphtha feed. An embodiment of the invention is one, any or all of prior embodiments in this paragraph up through the second embodiment in this paragraph wherein the $C_7$ stream from the naphtha splitter further comprises at least one aromatic compound, and further comprising hydrogenating at least a portion of the aromatic compounds in the $C_7$ stream from the naphtha splitter before isomerizing the $C_7$ stream from the naphtha splitter. An embodiment of the invention is one, any or all of prior embodiments in this paragraph up through the second embodiment in this paragraph further comprising mixing at least one additional stream with the gasoline blend.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

What is claimed is:

1. An integrated process for production of gasoline comprising:

separating a naphtha feed in a naphtha splitter into a light stream comprising $C_6$ and lighter boiling hydrocarbons, a $C_7$ stream comprising $C_7$ hydrocarbons, and a heavy stream comprising $C_8$ and heavier hydrocarbons;

isomerizing at least a portion of the light stream from the naphtha splitter in a $C_5$-$C_6$ isomerization zone at isomerization conditions to form a $C_5$-$C_6$ isomerization effluent;

isomerizing the $C_7$ stream from the naphtha splitter in a first $C_7$ isomerization zone at first isomerization conditions favoring the formation of multi-branched $C_7$ paraffins and cyclohexanes to form a first $C_7$ isomerization effluent;

deisoheptanizing at least a portion of the first $C_7$ isomerization effluent in a deisoheptanizer into at least a first stream comprising multi-branched $C_7$ paraffins and a bottom stream comprising n-$C_7$ paraffins and $C_7$ cycloalkane hydrocarbons;

introducing the bottom stream from the deisoheptanizer and an aromatic-containing stream comprising at least one aromatic compound into a second $C_7$ isomerization zone and controlling a flow rate of the aromatic-containing stream to control a temperature in the second $C_7$ isomerization zone;

isomerizing the bottom stream from the deisoheptanizer and the aromatic-containing stream in the second $C_7$ isomerization zone at second isomerization conditions favoring the formation of cyclopentanes over cyclohexanes to form a second $C_7$ isomerization effluent;

reforming the heavy stream from the naphtha splitter in a reforming zone under reforming conditions forming a reformate effluent;

blending one or more of: at least a portion of the $C_5$-$C_6$ isomerization effluent, the first stream from the deisoheptanizer, at least a portion of the second $C_7$ isomerization effluent, or the reformate effluent to form a gasoline blend.

2. The process of claim 1 wherein the aromatic-containing stream comprises at least one of benzene or toluene.

3. The process of claim 1 further comprising:

introducing a cycloalkane-containing stream comprising at least one cycloalkane compound to the second $C_7$ isomerization zone.

4. The process of claim 3 wherein the cycloalkane-containing stream has a cyclopentanes/cycloalkanes molar ratio of about 1:2 or less.

5. The process of claim 1 further comprising:

hydroprocessing the naphtha feed before separating the naphtha feed.

6. The process of claim 1 wherein the $C_7$ stream from the naphtha splitter further comprises at least one aromatic compound, and further comprising:

hydrogenating at least a portion of the aromatic compounds in the $C_7$ stream from the naphtha splitter before isomerizing the $C_7$ stream from the naphtha splitter.

7. The process of claim 1 further comprising:

separating the first $C_7$ isomerization effluent into an overhead stream comprising hydrogen and $C_4$ and lower boiling hydrocarbons and a second heavy stream comprising $C_5$ and heavier hydrocarbons before deisoheptanizing at least the portion of the first $C_7$ isomerization effluent, and wherein deisoheptanizing at least the portion of the first $C_7$ isomerization effluent comprises deisoheptanizing the second heavy stream.

8. The process of claim 1 further comprising:

separating the second $C_7$ isomerization effluent into a second overhead stream comprising hydrogen and $C_4$ and lower boiling hydrocarbons and a $C_7$ isomerized stream comprising $C_5$ and heavier hydrocarbons, and wherein blending one or more of: the at least the portion of the $C_5$-$C_6$ isomerization effluent, the first stream from the deisoheptanizer, the at least the portion of the second $C_7$ isomerization effluent, and the reformate effluent to form the gasoline blend comprises blending one or more of: the at least the portion of the $C_5$-$C_6$ isomerization effluent, the first stream from the deisoheptanizer, the $C_7$ isomerized stream, and the reformate effluent to form the gasoline blend.

9. The process of claim 1 further comprising:

separating the $C_5$-$C_6$ isomerization effluent into a third overhead stream comprising hydrogen and $C_4$ and lower boiling hydrocarbons and a $C_5$-$C_6$ isomerized stream comprising $C_5$ and heavier hydrocarbons, and wherein blending one or more of: the at least the portion of the $C_5$-$C_6$ isomerization effluent, the first stream from the deisoheptanizer, the at least the portion of the second $C_7$ isomerization effluent, or the reformate effluent to form the gasoline blend comprises blending one or more of: at least a portion of the $C_5$-$C_6$ isomerized stream, the first stream from the deisoheptanizer, the at least the portion of the second $C_7$ isomerization effluent, or the reformate effluent to form the gasoline blend.

10. The process of claim 1 wherein the first isomerization conditions include a temperature in a range of 40° C. to 235° C., or wherein the second isomerization conditions include a temperature in a range of 150° C. to 350° C., or both.

11. The process of claim 1 further comprising:

mixing at least one additional stream with the gasoline blend.

12. The process of claim 1, further comprising at least one of:

sensing at least one parameter of the process and generating a signal or data from the sensing;

generating and transmitting a signal; or generating and transmitting data.

13. The process of claim 12 further comprising:

mixing at least one additional stream with the gasoline blend.

14. An integrated process for production of gasoline comprising:

separating a naphtha feed in a naphtha splitter into a light stream comprising $C_6$ and lighter boiling hydrocarbons, a $C_7$ stream comprising $C_7$ hydrocarbons, and a heavy stream comprising $C_8$ and heavier hydrocarbons;

isomerizing at least a portion of the light stream from the naphtha splitter in a $C_5$-$C_6$ isomerization zone at isomerization conditions to form a $C_5$-$C_6$ isomerization effluent;

isomerizing the $C_7$ stream from the naphtha splitter in a first $C_7$ isomerization zone at first isomerization conditions favoring the formation of multi-branched $C_7$ paraffins and cyclohexanes to form a first $C_7$ isomerization effluent;

separating the first $C_7$ isomerization effluent into an overhead stream comprising hydrogen and $C_4$ and lower boiling hydrocarbons and a second heavy stream comprising $C_5$ and heavier hydrocarbons;

deisoheptanizing the second heavy stream in a deisoheptanizer into at least a first stream comprising multi-branched $C_7$ paraffins and a bottom stream comprising n-$C_7$ paraffins and $C_7$ cycloalkane hydrocarbons;

introducing the bottom stream from the deisoheptanizer and an aromatic-containing stream comprising at least one aromatic compound into a second $C_7$ isomerization zone and controlling a flow rate of the aromatic-containing stream to control a temperature in the second $C_7$ isomerization zone;

isomerizing the bottom stream from the deisoheptanizer and the aromatic-containing stream in the second $C_7$ isomerization zone at second isomerization conditions favoring the formation of cyclopentanes over cyclohexanes to form a second $C_7$ isomerization effluent;

reforming the heavy stream from the naphtha splitter in a reforming zone under reforming conditions forming a reformate effluent;

blending one or more of: at least a portion of the $C_5$-$C_6$ isomerization effluent, the first stream from the deisoheptanizer, at least a portion of the second $C_7$ isomerization effluent, or the reformate effluent to form the gasoline blend.

15. The process of claim 14 wherein the at least one aromatic compound comprises at least one of benzene or toluene.

16. The process of claim 14 further comprising:

introducing a cycloalkane-containing stream comprising at least one cycloalkane compound to the second $C_7$ isomerization zone.

17. The process of claim 16 wherein the cycloalkane-containing stream has a cyclopentanes/cycloalkanes molar ratio of about 1:2 or less.

18. The process of claim 14 wherein the first isomerization conditions include a temperature in a range of 40° C. to 235° C., or wherein the second isomerization conditions include a temperature in a range of 150° C. to 350° C., or both.

19. The process of claim 14 further comprising:

hydroprocessing the naphtha feed before separating the naphtha feed.

20. The process of claim 14 wherein the $C_7$ stream from the naphtha splitter further comprises at least one aromatic compound, and further comprising:

hydrogenating at least a portion of the aromatic compounds in the $C_7$ stream from the naphtha splitter before isomerizing the $C_7$ stream from the naphtha splitter.

* * * * *